United States Patent [19]

Doss

[11] 4,378,727

[45] Apr. 5, 1983

[54] DATA STATION WITH WIRE AND AIR DUCT

[75] Inventor: James A. Doss, Spring Lake, Mich.

[73] Assignee: Structural Concepts Corporation, Spring Lake, Mich.

[21] Appl. No.: 163,788

[22] Filed: Jun. 27, 1980

[51] Int. Cl.[3] ..... F24F 7/00

[52] U.S. Cl. ..... 98/33 R; 98/39; 98/43 B; 108/50; 108/60; 312/236

[58] Field of Search ..... 98/32, 33 R, 33 A, 42 R, 98/43 R, 43 B, 115 R, 37, 39, 115 LH; 108/50, 108/60; 126/299 R; 312/236, 239

[56] References Cited

U.S. PATENT DOCUMENTS

| | | | |
|---|---|---|---|
| 1,194,527 | 8/1916 | McNamara | 98/115 R X |
| 2,507,634 | 5/1950 | Hill | 108/50 X |
| 2,970,874 | 2/1961 | Honeycutt et al. | 312/223 |
| 3,083,417 | 4/1963 | Cook | 108/60 X |
| 3,361,508 | 1/1968 | Chassevent | 312/239 |
| 3,698,104 | 10/1972 | Sutton | 108/60 X |
| 3,759,297 | 9/1973 | Anderson et al. | 138/156 |
| 3,766,906 | 10/1973 | Jenn | 126/299 R |
| 3,770,334 | 11/1973 | Weber | 312/223 |
| 3,856,981 | 12/1974 | Boundy | 174/48 |
| 3,922,045 | 11/1975 | Meyer | 312/108 |
| 4,056,297 | 11/1977 | Gartung | 339/23 |
| 4,094,256 | 6/1978 | Holper et al. | 108/50 |
| 4,109,144 | 8/1978 | Vidmar | 98/43 B X |
| 4,135,440 | 1/1979 | Schmidt et al. | 98/31 |

FOREIGN PATENT DOCUMENTS

| | | | |
|---|---|---|---|
| 2650222 | 5/1978 | Fed. Rep. of Germany | 98/32 |

*Primary Examiner*—Albert J. Makay
*Assistant Examiner*—Harold Joyce
*Attorney, Agent, or Firm*—Varnum, Riddering, Wierengo & Christenson

[57] ABSTRACT

An open space office system comprises a plurality of freestanding work stations (10) constructed of vertical panels (14) and horizontal work surfaces (12). The room in which the work stations (10) are arranged are provided with a central ventilation means (41) which provides air circulation in the room. Each work station (10) includes at least one common conduit (26) arranged adjacent the work surface (12) thereof. A vent (35) disposed in each of the work stations (10) communicates with the conduit (26) thereby providing an air flow path from the central ventilation system (41) through the room to the conduit (26). In this way, return air of the ventilation system is evacuated from the room by means of the conduits (26). The conduits (26) are typically connected to a central return air duct (42).

2 Claims, 8 Drawing Figures

DATA STATION WITH WIRE AND AIR DUCT

BACKGROUND OF THE INVENTION

1. Field of the Invention

The invention relates to freestanding office systems including modular work stations wherein the work stations include a common conduit which serves as an air return duct for the office.

2. State of the Prior Art

Open space office systems including freestanding work stations have enjoyed great utility and provide a simple means for designing and reconfiguring office areas. The work stations are generally formed from a number of vertical panels which are assembled in a predetermined configuration so as to divide an office space into a number of discrete work areas. The vertical panels may support work surfaces, storage cabinets or the like so that each worker is provided with a certain degree of privacy. One of the important advantages of such an office system is that it provides much flexibility for reconfiguring the office design as needed.

In order to maintain the flexibility of the open space system, it is desirable to avoid any type of permanent utility structures such as electrical conduits and heating and ventilation ducts. In this regard, some office systems include utility conduits which are mounted to the vertical panels as the system, such as disclosed in the Gartung U.S. Pat. No. 4,056,297 issued Nov. 1, 1977. Such utility conduits provided on a vertical panel allow electrical cabling and the like to be carried on the office components instead of being permanently mounted in the ceiling or the floor.

Another type of utility conduit arrangement for use in open office systems is that shown in the Boundy U.S. Pat. No. 3,856,981, issued Dec. 24, 1974. In the Boundy patent, the vertical panels include a vertically extending tube for attachment to ceiling panels in which permanent utility structures are mounted. It also has been known to provide a conduit on the work station such as that shown in the Meyer U.S. Pat. No. 3,922,045 issued Nov. 25, 1975 wherein a cable conduit is attached below the work surface of a modular work station so that the cable conduit extends between adjacent work areas. Another form of utility conduit arrangement is that shown in the Anderson et al U.S. Pat. No. 3,759,297 issued Sept. 18, 1973, wherein a utility conduit is mounted to the vertical panels of an open space system.

Some work areas have been provided with an air supply system such as that shown in the Holper et al U.S. Pat. No. 4,094,256 issued June 13, 1978. In the Holper patent, the work table includes ducts in the side member supports of the table which provide for air supply and return. Each desk, however, must include a separate air supply mounted in the floor of a room and therefore does not provide the flexibility desired of an open space office system.

While the above references show the concept of carrying telephone or electrical lines in an open space system, they do not reach the problem of providing heating and ventilation in the office space in which the modular work stations are located. In the past, the entire office space has been heated and cooled by means of a circulation system including ducting and vents which are mounted in the permanent walls or ceilings of an office building. Typically, the floors of an office building will be spaced a distance sufficient to accomodate air conditioning and/or heating ducts. Since a typical use of the open office concept is with machines which generate heat, such as typewriters, CRT display devices and the like, it is necessary to remove the heat generated by these machines in order to provide a comfortable work environment. A central heating and ventilation system for an office space will not adequately remove the heat generated by the office machines. Instead, it is much more desirable to remove the heat at its source by means of ducts or the like which are located within the modular work station, with these ducts communicating to a central exhaust. In this way, the permanent structures such as ducts mounted in ceilings, floors, walls and the like used in the traditional heating and ventilation system can be eliminated. By dispensing with permanently mounted heating and ventilation ducts, a more efficient use of an office space can be made while the flexibility of the open space office system is maintained.

DESCRIPTION OF THE INVENTION

In accordance with the invention, an open space office system includes a plurality of vertical wall panels arranged in an office space in a predetermined configuration so as to divide the office space into separate work areas. These vertical panels are freestanding and supported independently of the structural members of the room and may support a horizontal work surface or the like for each worker. The vertical panels which form the separate work stations define at least one conduit which runs adjacent to the horizontal work surfaces. Mounted in the work surfaces or on the vertical panels are vents or grates which allow for the passage of the ambient air in the office space to the conduit. In this way, an air circulation system can be provided for the work space wherein air is communicated through the conduits to and from the office space. This eliminates the need for providing a central ventilation system for the work space.

The conduit is formed by a number of vertical and horizontal panels which make up the freestanding work station. The panels which form the conduit are connected in a conventional manner and may be the kickpanels which are located beneath the work surface at each work station. The conduit therefore runs between adjacent work stations and has an inlet or outlet at one of the walls, for example, of the office space. As can be seen, it is necessary to provide only a small number of registers in the office structure for communicating with the conduits. This arrangement is in distinction to the traditional system of heating and ventilating offices wherein a number of such vents and registers are mounted in the building walls. In order to provide for circulation in the office, the conduit may communicate with a fan which provides for forced-air circulation.

In order to solve the problem of removing heat generated by office machines such as typewriters, each work space includes a vent, either in the horizontal work surface or in one of the vertical panels, which communicates with the conduit. In this way, the heat generated by the machine is directly communicated to the exhaust without being transmitted into the remainder of the office. This immediate removal of the heat increases operator comfort and creates a desirable air flow in the office space.

Other forms of conduits such as a vertical conduit which is central to a number of radially-arranged work areas may also be employed. Such a vertical conduit may communicate to an exhaust provided in the ceiling of a work space. It is apparent that the particular configuration and location of the conduit in the work station can be selected to meet the needs of the office system.

BRIEF DESCRIPTION OF THE DRAWINGS

The invention will be described with reference to the accompanying drawings wherein like members bear like reference numerals in which.

DETAILED DESCRIPTION OF THE INVENTION

Figure 1:
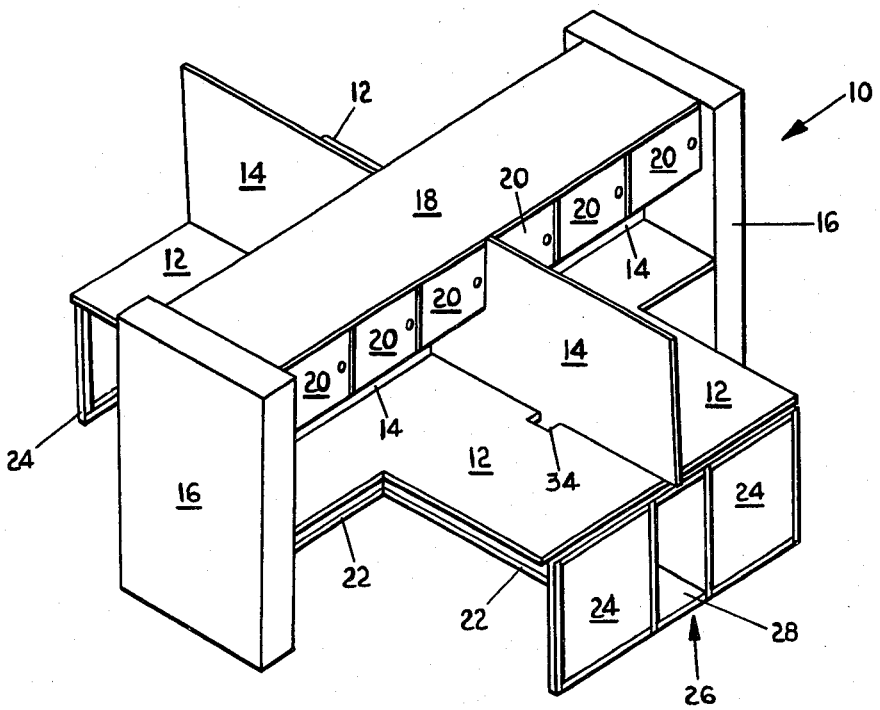
FIG. 1 is a perspective view of a modular work station including the conduit in accordance with the invention.
Figure 2:
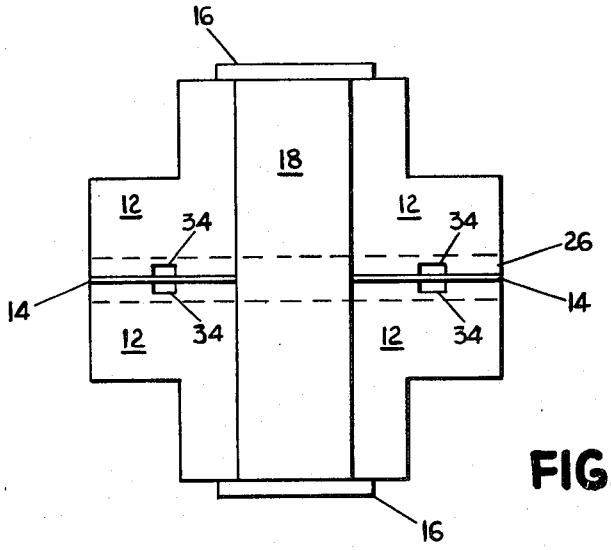
FIG. 2 is a plan view of FIG. 1 showing the location of the conduit in phantom.
Figure 3:
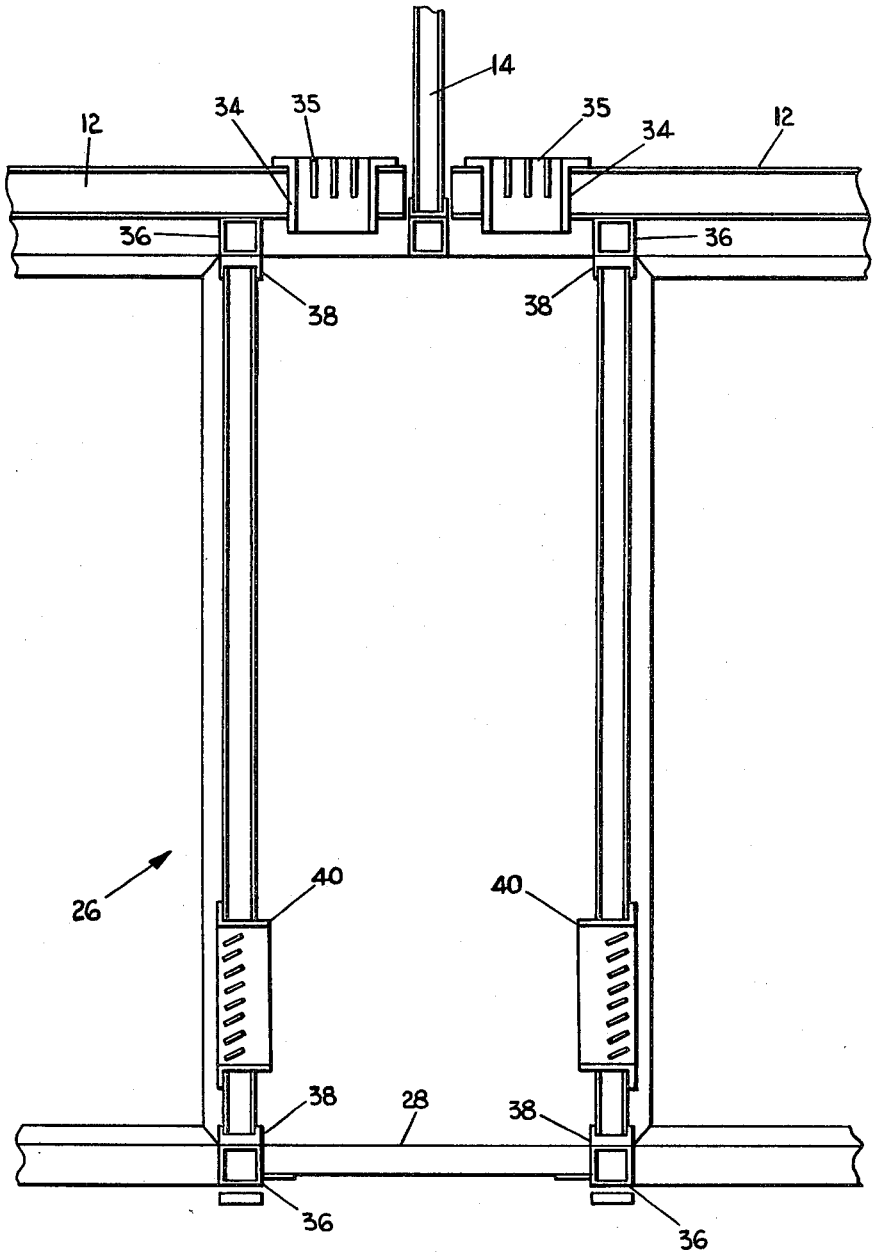
FIG. 3 is a detailed end view of the work station shown in FIG. 1 showing the conduit in section.

With reference to FIGS. 1–3, a freestanding work module 10 in accordance with the invention is formed of a plurality of freestanding vertical divider panels 14 which divide an interior office space into a series of work areas. It is contemplated that a number of such work modules 10 would be placed in one room so as to form an open space office system. The vertical divider panels 14, as shown in FIG. 1, comprise four panels arranged in perpendicular planes so as to divide the work module 10 into four work areas.

Supported on the panels 14 are a number of horizontal work surfaces 12. The work surfaces 12 may be secured to the panels by brackets or by similar conventional fastening means. In order to provide further support for the module 10 and increase the privacy in each work area, additional vertical panels 16 may be included perpendicular to the ends of one set of panels 14. These vertical panels 16, in conjunction with one set of divider panels 14 may support a storage area 18 above the work surface 12. The storage area includes a plurality of drawers 20.

Beneath each work surface 12 are bottom panels 22 which serve to divide the undersurfaces of each work area. The work module 10 also may include bottom end panels 24 which further enclose each work area of the work module 10. All of these panels are connected in a conventional manner by snap-like connectors or a similar fastening device. For example, one type of connector for securing panels together is that shown in U.S. Pat. No. 3,532,369 issued Oct. 6, 1970. The work module 10 as described above is fairly conventional in structure.

In accordance with the invention, each such work module 10 includes a conduit 26 extending beneath the work surfaces 12 and adjacent to all of the work areas at each work module 10. The conduit 26, which may have a rectangular configuration, includes side walls which are formed by the bottom panels 22 of the work module 10. In order to enclose the conduit 26, a bottom panel 28 is mounted between the upstanding bottom panels 22 and spaced from the work surfaces 12. The top wall of the conduit 26 may be formed by the undersides of the work surfaces 22 or by a separate panel mounted beneath the work surfaces. Included in each work surface 12 is an opening 34 in which a vent or grate may be mounted. This opening 34 provides for communication between the ambient air in the office space and the conduit 26. The location of each opening 34 with respect to the conduit 26 is better shown in FIG. 2 which illustrates the conduit extending between all work areas of the module 10.

FIG. 3 shows the structure of the conduit 26 in greater detail. The panels which comprise the work station and the conduit are fairly conventional in nature and include channels 36 which support a generally rectangular acoustical panel. The channels may be joined by fasteners such as that shown in U.S. Pat. No. 3,532,369. The channels may be joined to the acoustical panel by means of a molding 38, such as described in U.S. Pat. No. 3,995,405, or a similar attachment. The molding shown in the U.S. Pat. No. 3,995,405 permits the accoustical panel to be removed from the frame to provide access to the interior of the conduit. In this way, any utility lines contained therein can be serviced. Alternatively, the entire panel may be removed to provide access to the conduit.

As shown, the openings 34 in the horizontal work surfaces 12 may be provided with vents 35 which allow for communication between the ambient air in a room and the conduit 26. In order to provide for increased air flow between the room and the conduit, a second grate 40 may be provided in the bottom panels 22 of each work module 10.

Figure 7:
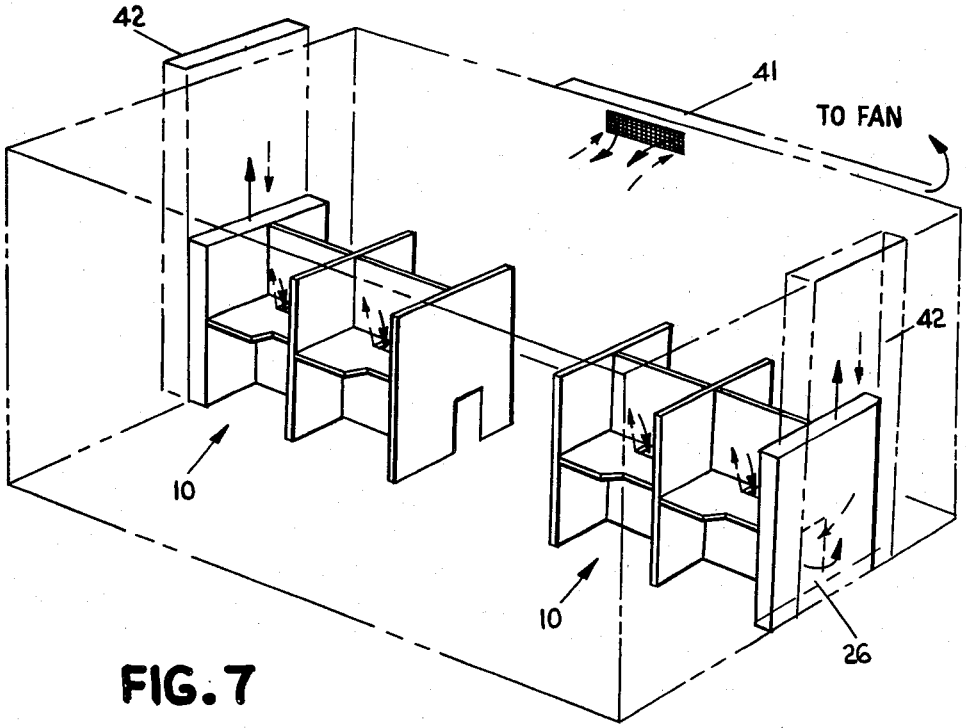
FIG. 7 is a perspective view of a room and a ventilation system therein including work stations in accordance with the invention.
Figure 8:
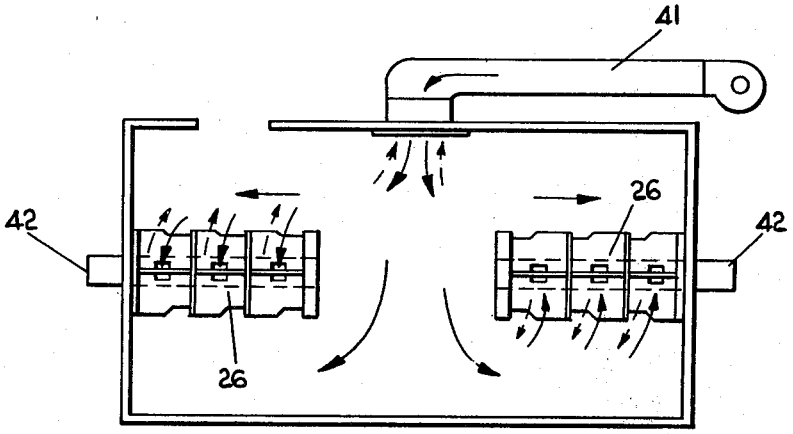
FIG. 8 is a schematic of an air circulation system for a room including work stations in accordance with the invention.

The conduit 26 provides a self-contained utility chase for each freestanding work module 10 in the open space office system. When placed in such an office system, one end of the module 10 is placed adjacent a register of a central ventilation system or another type of utility duct. In this way, air circulation in a room, for example, may be provided through the conduit 26 which is self-contained within each work station. It is contemplated that the conduit 26 will replace the wall-mounted or ceiling-mounted registers necessary for air return from an office space. Heat generated in the office space and in particular on the surfaces 12 will be drawn into the conduit 26 through the vents 35 and 40 and exhausted through the conduit to a central exhaust duct in the building structure. Since an important application of such freestanding office systems is with office machines such as typewriters, CRT diplay devices and the like, which generate a great deal of heat, the provision of the vent 35 in the work surface allows for immediate removal of this heat from the room before it dissipates. Further, air circulation is enhanced and more evenly distributed in the room by channeling the return air through conduit 26 in distinction to the registers which are mounted in the building structure. The air flow pattern in an office including modules 10 is illustrated in FIGS. 7 and 8. Air flow in the air return mode is illustrated by the solid-line arrows. Air is discharged from a central heating and ventilation source 41 into the room and returns through conduits 26, which communicate to central exhaust ducts 42. The ducts 42 may be in the walls or ceiling of a room or be located in an interior structural support in which case the modules 10 are arranged about the support. One form of exhaust duct may be a vertical duct located in the walls of a building as shown in FIG. 8.

Figure 4:
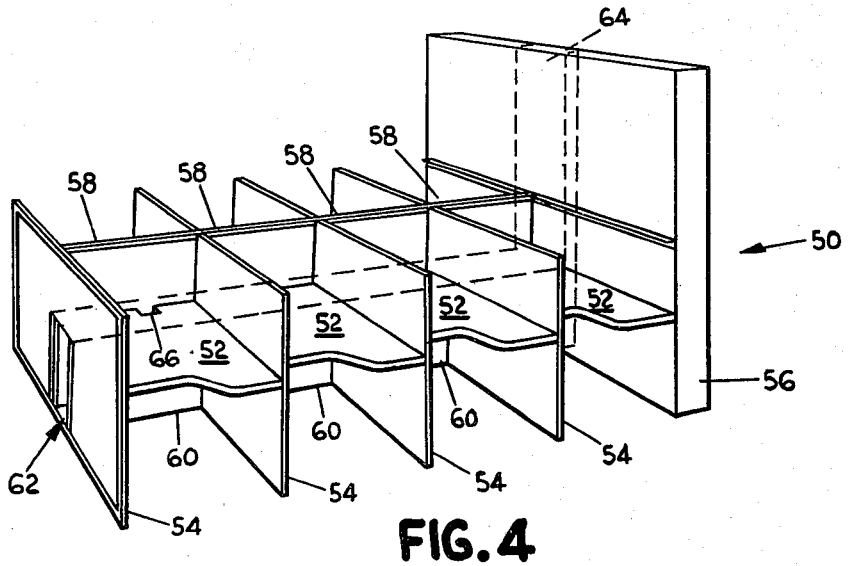
FIG. 4 is a perspective view of another embodiment of a modular work station including a conduit in accordance with the invention.

Other work module configurations also can be provided with a conduit as described above. With reference to FIG. 4, another embodiment of a module 50 is shown wherein a plurality of work areas are arranged about a central conduit. The work module 50 is formed of a plurality of vertical panels 54 which are disposed perpendicular to dividers 58 and 60. Within each space created by the panels 54, 58 and 60 are horizontal work surfaces 52 similar to those described above with reference to FIG. 1. One end of the work module 50 may include an enlarged end panel 56 in which a vertically extending conduit 64 may be disposed. This conduit 64 is in communication with a horizontal conduit 62 which extends adjacent the work areas formed by the vertical and horizontal panels in a manner similar to that described above. The conduits 62 and 64, therefore, cooperate to form a utility chase which is self-contained in each work area. If the conduits 62 and 64 are to be used as an air return path for a room, then the horizontal work surfaces 52 would include vents 66 in which grates may be positioned such as described above.

Figure 5:
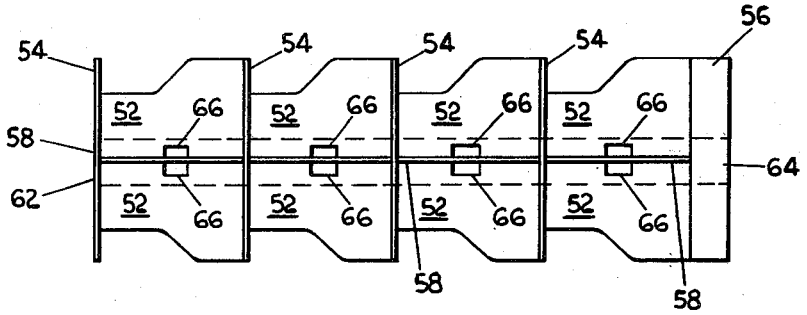
FIG. 5 is a plan view of FIG. 4 showing the conduit in phantom.

The vertical conduit 64 allows the return air to be communicated to a central exhaust duct which may be positioned in the ceiling of a room. The conduit 62 and 64 therefore provides a central utility chase for all work stations in the module 50, and in particular, provides an air return system for an open space office. FIG. 5, which is a plan view of the module 50, shows that the conduit is arranged adjacent to each work surface 52. In this way, any heat, odors or smoke generated at a work area are quickly evacuated without dissipating into the room.

Figure 6:
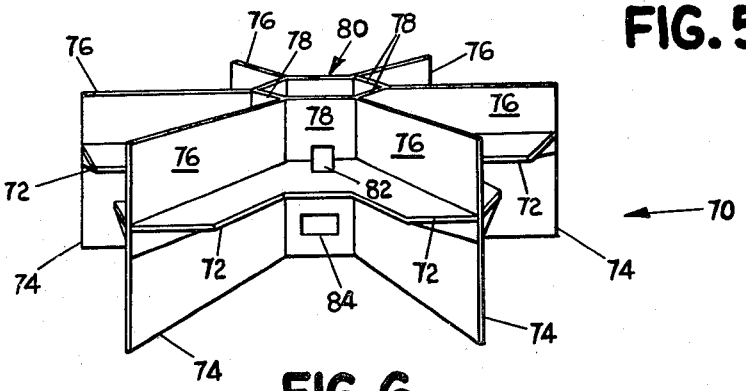
FIG. 6 is a perspective view of still another embodiment of a work station including a conduit in accordance with the invention.

FIG. 6 shows another form of a work module in which a plurality of work areas are arranged about a central conduit 80. A work module 70 includes a plurality of radially extending vertical panels 74 and 76 which divide the upper and lower portions of each work area. The vertical panels 74 and 76 extend from a hexagonal conduit portion 80 formed by a plurality of vertical walls 78. Mounted in each work area formed by the vertical panels 78 is a horizontal work surface 72 similar to that described above. In order to provide for communication between the ambient air in a room and the conduit 80 formed by the vertical walls 78. Grates 82 and 84 are mounted in the vertical panel 78. While the conduit is shown as a hexagon, other polygonal shapes may be used depending upon the number of work areas which are desired. Additionally, the height of the conduit 80 may be increased so as to communicate with a central air return in the ceiling of a room, for example. Alternatively, the open end of the conduit 80 may be closed by a top panel and the bottom end which is seated against the floor may communicate to an exhaust duct located in the floor of a room. It is apparent that a variety of conduit configurations may be selected in order to meet with the requirements for a particular open space office system.

As can be seen from the foregoing, a work module including a self-contained utility conduit can be used to remove air from a room. The conduits permit the elimination of the typical air return registers which are mounted in the ceiling, floor and walls of the building and require that there only be one or two exhaust vents to which the central conduits can be connected. In this way, expensive permanent ducting which is mounted in the ceiling or floor of a building can be eliminated and the space used for other purposes. Alternatively, the space for utilities between floors can be greatly reduced, thus saving building costs. Since the conduit is contained in the work module itself, the flexibility of the open space office system is enhanced, since the modules do not have to be positioned near any particular ventilation ducts.

By including vents in each work module, heat generated at that location can be removed efficiently without dissipating into the room. This is important since many of the work modules are used with heat generating machines such as CRT modules and the like. Further operator-generated smoke is removed near the source without dissipating into the room. By removing the heat at its source, operator comfort is increased and a comfortable air flow through the room is maintained. Locating the vents for removal of air at the work station level also provides an efficient air return system for use with both heating and air conditioning systems. In this respect, the grates provide a compromise between the preferred ceiling air return systems for air conditioning and the floor air return systems for heating. In this way the need for providing two register systems is eliminated.

While the invention has been described with reference to providing an air return system for an open space office, the conduit can function as an air supply system by providing heated or cooled air through the vents. Air flow when the system is functioning as an air supply system system is illustrated in FIGS. 7 and 8 by the dotted-line arrows. Additionally, the conduit may communicate with a forced-air ventilation system so as to enhance air flow in the office space. The conduit may also be divided to provide both return and add air supplies. Other utility cables such as electrical and telephone lines may be positioned in the conduit without interfering with the air return system.

The foregoing specification and drawings are merely illustrative of the invention and are not intended to limit the invention to the disclosed embodiments. Variations and changes which are obvious to one skilled in the art are intended to be within the scope and nature of the invention which is defined in the appended claims.

The embodiments of the invention in which an exclusive property or privilege is claimed are defined as follows:

1. In an open space office system including:

a room;

freestanding work stations including vertical panels and horizontal work surfaces supported by said vertical panels, said work stations being arranged about said room in a selected configuration for dividing the room into separate interrelated work areas;

ventilation means for providing air circulation in said room;

the improvement which comprises:

said vertical panels arranged to form a vertical conduit with said work surfaces being radially arranged about said vertical conduit;

said conduit arranged adjacent said work surfaces;

port means in said work areas communicating air between said ventilation means and said conduit;

duct means communicating with said conduit for either withdrawing air from said room through said port means or for supplying air to said room through said port means;

wherein air circulating in said room is communicated to said duct means by said conduit or air is supplied to said room from said ventilation means through said conduit.

2. The system of claim 1 wherein said port means is disposed in a vertical panel adjacent said work surface.

* * * * *